US011826820B2

(12) United States Patent
Wohltmann et al.

(10) Patent No.: US 11,826,820 B2
(45) Date of Patent: Nov. 28, 2023

(54) ARRANGEMENT FOR LOW-PRESSURE CASTING OF REFRACTORY METALS

(71) Applicant: Fraunhofer-Gesellschaft zur Förderung der Angewandten Forschung e.V, Munich (DE)

(72) Inventors: Carsten Wohltmann, Bremen (DE); Arne Otto-Radtke, Bremen (DE); Marco Haesche, Bremen (DE); Franz-Josef Woestmann, Bremen (DE); Michael Heuser, Bremen (DE); Jan Eilers, Bremen (DE)

(73) Assignee: FRAUNHOFER-GESELLSCHAFT ZUR FOERDERUNG DER ANGEWANDTEN FORSCHUNG E.V, Munich (DE)

( * ) Notice: Subject to any disclaimer, the term of this patent is extended or adjusted under 35 U.S.C. 154(b) by 38 days.

(21) Appl. No.: 17/621,501

(22) PCT Filed: Jun. 23, 2020

(86) PCT No.: PCT/EP2020/067442
§ 371 (c)(1),
(2) Date: Dec. 21, 2021

(87) PCT Pub. No.: WO2020/260245
PCT Pub. Date: Dec. 30, 2020

(65) Prior Publication Data

US 2022/0347742 A1 Nov. 3, 2022

(30) Foreign Application Priority Data

Jun. 27, 2019 (DE) ..... 102019209389.2

(51) Int. Cl.
*B22D 18/04* (2006.01)
*B22D 21/02* (2006.01)
(Continued)

(52) U.S. Cl.
CPC ..... *B22D 18/04* (2013.01); *B22D 21/022* (2013.01); *F27B 14/063* (2013.01); *F27D 11/06* (2013.01);
(Continued)

(58) Field of Classification Search
CPC ..... B22D 18/04
See application file for complete search history.

(56) References Cited

U.S. PATENT DOCUMENTS 3,188,703 A * 6/1965 Le Jeune ..... B22D 18/04 164/331
4,726,414 A 2/1988 Merrien
(Continued)

FOREIGN PATENT DOCUMENTS

CH 476272 A 7/1969
CN 106925755 A * 7/2017
(Continued)

OTHER PUBLICATIONS

German Examination Report from counterpoint Germany application No. 10 2019 209 389.2 the examination report dated Feb. 27, 2020.
(Continued)

*Primary Examiner* — Keith Walker
*Assistant Examiner* — Jacky Yuen
(74) *Attorney, Agent, or Firm* — Renner, Kenner, Greive, Bobak, Taylor & Weber

(57) ABSTRACT

The present invention relates to an arrangement for low-pressure casting of refractory metals, with a furnace chamber with one or a plurality of gas supply openings (6) and gas outlet openings (7), and a riser pipe (8) through a cover (5) of the furnace chamber, a melting container (3, 12) for the refractory metals arranged in the furnace chamber, and a heating device for heating the refractory metals in the
(Continued)

melting container (3, 12). In the proposed arrangement, the melting container (3, 12) is formed as an exchangeable insert for a receiving mould (2) supporting the melting container (3, 12), which is arranged in the furnace chamber, wherein a thermally insulating layer (4, 17) is formed between the receiving mould (2) and the melting container (3, 12), or is integrated into the melting container (3, 12). With the proposed arrangement, a quick and easy exchange of the melting container for different alloys can also be carried out in the low-pressure casting of refractory metals.

6 Claims, 7 Drawing Sheets

(51) Int. Cl.

| | |
|---|---|
| ***F27B 14/06*** | (2006.01) |
| ***F27D 11/06*** | (2006.01) |
| ***F27B 14/08*** | (2006.01) |
| ***F27B 14/10*** | (2006.01) |

(52) U.S. Cl.
CPC . *F27B 2014/0843* (2013.01); *F27B 2014/104* (2013.01); *F27B 2014/108* (2013.01)

(56) References Cited

U.S. PATENT DOCUMENTS

| | | | | |
|---|---|---|---|---|
| 4,791,977 | A * | 12/1988 | Chandley | B22D 18/04 164/63 |
| 5,919,392 | A | 7/1999 | Myers | |
| 6,196,294 | B1 * | 3/2001 | Ohnsmann | B22D 27/11 164/133 |
| 6,684,934 | B1 | 3/2004 | Cargill | |
| 7,507,366 | B2 * | 3/2009 | Mizuno | B22D 41/12 266/286 |

FOREIGN PATENT DOCUMENTS

| | | | |
|---|---|---|---|
| CZ | 285114 | B6 | 5/1999 |
| DE | 1068432 | A | 11/1959 |
| DE | 00002428263 | A1 | 6/1974 |
| EP | 0206967 | B1 | 6/1989 |
| JP | 09303969 | A * | 11/1997 |

OTHER PUBLICATIONS

International Search Report from PCT application No. PCT/EP2020/067442, p. 1-2, dated Sep. 8, 2020.

* cited by examiner

ARRANGEMENT FOR LOW-PRESSURE CASTING OF REFRACTORY METALS

TECHNICAL FIELD OF APPLICATION

The present invention relates to an arrangement for low-pressure casting of refractory metals, which has a furnace chamber with one or a plurality of gas supply and gas outlet openings, and a riser pipe through a cover of the furnace chamber, a melting container for the refractory metals arranged in the furnace chamber, and a heating device for heating the refractory metals in the melting container.

In low-pressure casting processes, a melting container, with the material to be cast, is positioned in a pressure-tight furnace chamber, which is closed off by a cover. A riser pipe runs through the cover between the melting container and the outside space, onto which a casting mould is positioned. Depending on the casting material and the application, permanent metal moulds (chill moulds), sand casting moulds, or investment casting moulds, are used as casting moulds. In the case of metallic casting material, the material is usually heated by an inductive heating device, which is arranged in the furnace chamber. To cast the component, a gas such as nitrogen or argon is introduced into the furnace chamber, which gas exerts a pressure on the molten pool in the melting container. This pressurisation causes the melt to rise slowly through the riser tube into the mould arranged above. The pressurisation is maintained until the entire component has solidified. After the gas pressure has been released, the residual melt can flow out of the riser tube back into the melting container. The component is then removed from the mould. The fundamental advantage of a low-pressure casting process compared to a conventional casting process lies, on the one hand, in the easily controllable, slow mould filling, which leads to high component qualities, and, on the other hand, in the reduction of the amount of material circulating, by virtue of the return flow of the melt located in the riser tube.

In the low-pressure chill casting process, it is predominantly non-ferrous metals such as aluminium and copper alloys that are processed. For this purpose, standardised crucibles made of aluminium oxide or silicon carbide are usually used as the melting containers; these are positioned in a free-standing manner in the furnace chamber of the low-pressure casting arrangement. This has the advantage that the crucible can be replaced very easily via the open cover in the event of a changeover of alloy.

However, such an arrangement cannot be used for low-pressure casting of refractory metals such as steel. In this case, a crucible made of ceramic would not withstand the high mechanical and thermal loads without additional support. However, support with a steel structure is not possible, as this would also be heated by the inductive heating of the molten metal, and would lose its mechanical stability. Furthermore, due to the high temperature differences between the inner face of the crucible, which is in the range of the melting or casting temperature, in the case of steel usually >1600° C., and the significantly lower temperatures on the outer face, high mechanical stresses would occur, which could lead to cracks in the crucible.

PRIOR ART

For the low-pressure casting of refractory materials, such as steels, the casting arrangements of known art therefore have a significantly modified structure. Here the casting system usually consists of a hollow steel body, which has a fixed furnace cladding (lining) to form a melting crucible. The furnace has various openings which are used for charging, melt treatment or for the removal of samples. The casting moulds, in particular sand moulds, are positioned on a funnel-shaped upper furnace opening, the casting nozzle. The melt is heated and kept hot inductively. A distinction is made here between crucible or channel furnaces or inductors. After application of an increased gas pressure to the melt surface, the mould is slowly filled with molten metal via the casting nozzle. Here, the casting pressure is also maintained until the component has solidified. The gas pressure is then released, and the residual melt runs back into the crucible. The advantages of this process lie in the slow and easily controllable filling of the mould, and the reduction of the amount of material circulating (smaller sprue system, lack of risers).

An arrangement for vertical low-pressure casting is described, for example, at www.otto-junker.com/de/produkte-technologien/anlagen-fuer-gusseisen-stahl/giessofen-fuer-niederdruckguss/, which has such a structure. In this arrangement, heating can take place by way of channel or crucible inductors. The entire furnace is supported by a substructure.

The low-pressure casting furnaces for steel of known art have a fixed furnace cladding, which is matched to the material to be processed. This means that it is not possible to changeover the casting material quickly. To changeover the material, the entire furnace cladding would have to be removed and relined.

From the Griffin Wheel Division a technique for the production of railway wheels using low-pressure steel casting is of known art, which enables the melting container to be replaced quickly. Here a casting ladle filled with the already molten steel is inserted into an airtight housing and closed with a cover. A casting ladle basically consists of a steel vessel that is clad with a ceramic lining. Exactly as with the other low-pressure casting systems, a casting mould located above the casting ladle is filled via a riser pipe by means of increased gas pressure. The disadvantage of this system, however, is the continuous cooling of the melt in the casting ladle, so that the casting time is correspondingly limited. Particularly in the production of thin-walled cast structures, restrictions can arise here due to the fluidity decreasing with the melting temperature.

The object of the present invention is to specify an arrangement for the low-pressure casting of refractory metals, which enables a quick changeover of metals or metal alloys, and is also suitable for the production of thin-walled cast structures.

PRESENTATION OF THE INVENTION

The object is achieved with the arrangement according to claim 1. Advantageous designs of the arrangement are subject of the dependent claims, or can be taken from the following description together with the examples of embodiment.

The proposed arrangement has a furnace chamber with one or a plurality of gas supply and gas outlet openings, and a riser pipe through a cover of the furnace chamber, onto which a casting mould can be positioned, a melting container arranged in the furnace chamber for the refractory metals or metal alloys, and a preferably inductive heating device, with which refractory metals located in the melting container can be heated. The arrangement is characterised in that the melting container is designed as a removable insert for a receiving mould in the furnace chamber, which supports the melting container, in particular also laterally, and in that a thermally insulating layer is formed between the receiving mould and the melting container, or is integrated with the melting container.

In a manner of known art, the furnace chamber can be closed off to be gas-tight relative to the outside space, so as to push a melt present in the melting container via the riser tube into a casting mould positioned on the riser tube by increasing the gas pressure in the furnace chamber. By designing the melting container as a removable and thus exchangeable insert, the container can be changed quickly and easily in order to carry out a changeover of alloy. The design, as an insert in a receiving mould, preferably supporting the entire periphery of the melting container, that is to say, the bottom surface and side surface(s), enables the necessary mechanical support when processing metals with a high density, such as steel. The thermally insulating layer significantly reduces temperature differences between the inside and the outside of the melting container, that is to say, the receiving mould, so that thereby thermally-induced mechanical stresses, which can lead to fracture of the melting container, are prevented, or at least significantly reduced. Here the receiving opening of the receiving mould is geometrically matched as far as possible to the outer shape of the melting container, in order to be able to support the latter over as large an area as possible. The one or plurality of induction coils of the heating device can here be integrated into the receiving mould.

In an advantageous design, the receiving mould has for this purpose an inner casing, preferably made of a ceramic material, into which one or a plurality of induction coils of the heating device for heating the metallic casting material are embedded. The inner casing is supported by an outer supporting structure, preferably of steel. The outer walls of the furnace chamber preferably constitute this supporting structure, so that the inner casing forms a cladding of the furnace chamber. In principle, however, it is also possible to position the receiving mould as a separate component in a furnace chamber.

The melting container can be designed as an insert in a receiving mould, which insert can be removed upwards, while the receiving mould correspondingly has the receiving opening at the top. Here, a fill of a high-temperature-resistant material, for example high alumina, is preferably introduced between the walls of the receiving opening and the melting container to form the thermally insulating layer. To this end, the receiving opening and the outer dimensions of the melting container are appropriately matched to one another in order to form a sufficiently large gap for the fill.

In another advantageous design, the receiving opening has a conical shape, which preferably narrows towards the top. In this design, the melting container is implemented with a correspondingly complementary conical shape, so that the outer face of the melting container, after insertion into the receiving opening, rests over its entire surface against the inner face of the receiving opening. The melting container is inserted from below into the downwardly open receiving opening, and is pressed into this opening by means of a suitable mechanism and held there. This mechanism can be designed in various ways, and can operate, for example, by means of compression springs, or also by means of a motor, or a hydraulic drive. To this end, the furnace chamber has a detachable base plate, which allows the melting container to be exchanged easily. In one possible design, the thermally insulating layer forms the outside of the melting container, and is applied to an inner casing, which is preferably formed from a ceramic material. For this purpose, the thermally insulating layer can be formed, for example, by a high-temperature-resistant non-woven material. In another design, the melting container has an inner casing, preferably made of a ceramic material, an intermediate filling made of a high-temperature-resistant material, for example high alumina, and an outer casing, preferably also made of a ceramic material. This outer casing can also be formed by a plurality of loosely superimposed rings and a base plate. In the aforementioned designs, the melting container can very easily be removed downwards from the receiving mould, and exchanged by merely detaching or removing the base plate of the furnace chamber.

The proposed arrangement is particularly suitable for the low-pressure casting of refractory metals, in which a changeover of the metals is to be carried out in a simple and quick manner.

BRIEF DESCRIPTION OF THE DRAWINGS

The proposed arrangement is again explained in more detail below with reference to examples of embodiment in conjunction with the drawings. Here.

PATHS TO THE EMBODIMENT OF THE INVENTION

In the proposed arrangement, the melting container is designed as an exchangeable insert of a receiving mould, which is arranged in the furnace chamber, or forms a cladding of the furnace chamber.

Figure 1:
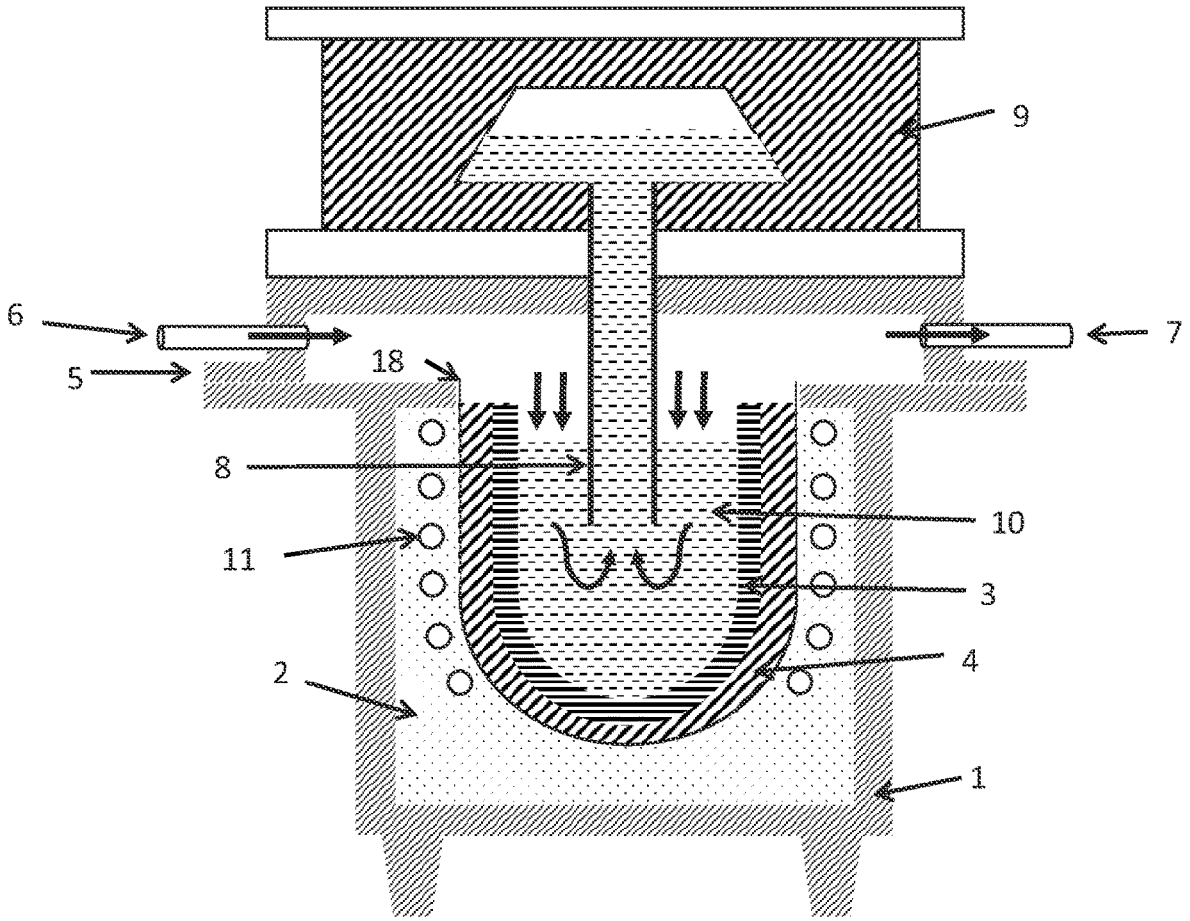
FIG. 1 shows in cross-section a first example of an arrangement according to the present invention.

To this end, FIG. 1 shows a first example of the proposed arrangement in a cross-sectional view. The furnace chamber is here formed by a steel frame 1, which is closed off by a removable cover 5. In this example, a gas supply 6 and a gas outlet 7 for increasing or decreasing the pressure in the furnace are located in the cover. Furthermore, a riser tube 8 extends through the cover, onto which tube a casting mould 9 is positioned. By increasing the gas pressure in the furnace chamber, the melt 10 in the melting container rises via the riser pipe 8 into the casting mould 9, so as to solidify there into the component to be cast.

In this arrangement, the melting container is formed by an inner crucible 3, which is inserted into a thick-walled outer crucible 2 as a receiving mould, and can also be later removed from the latter. Windings of the induction coil(s) 11 of the heating device are integrated into the outer crucible 2, which is formed from a heat-resistant material. In the present example, this outer crucible 2 forms a cladding of the steel frame 1, and is connected to supply lines for the induction coil(s) 11. The inner crucible 3 for receiving the molten metal is inserted into the outer crucible 2 as a receiving mould, wherein the cavity between the two crucibles is filled with a heat-resistant fill 4, for example of high alumina. The mechanical load during casting of refractory metals, for example steel, is absorbed by the outer steel frame 1. There is no need to worry about inductive coupling into this steel structure, since the induction coils 11 are located inside the outer crucible 2, and the steel frame 1 lies outside the magnetic field of the coils. Furthermore, the thermally insulating effect of the fill 4 results in a more uniform heating of the inner crucible 3 over the wall thickness, and thus lower thermally-induced mechanical stresses.

The furnace chamber is closed with the pressure-tight cover 5, which has a central opening for the riser tube 8. By virtue of the compact design of this arrangement for low-pressure casting, a small volume of gas is required to apply the pressurisation, whereby costs (less gas consumption) and the time required to apply the gas pressure, can be reduced. The exchangeable inner crucible 3 enables a quick and easy exchange between alloys. To prevent contact between the induction coil or coils 11 and the molten metal 10 in the event of a fracture of the inner crucible 3, a melt detection system 18 can be positioned between outer crucible 3 and the fill 4, for example a wire mesh connected to a measuring device. In the event of contact with the molten metal, the heating device would then be automatically switched off. Such a melt detection system 18 can also be used in the further designs described below.

Figure 2:
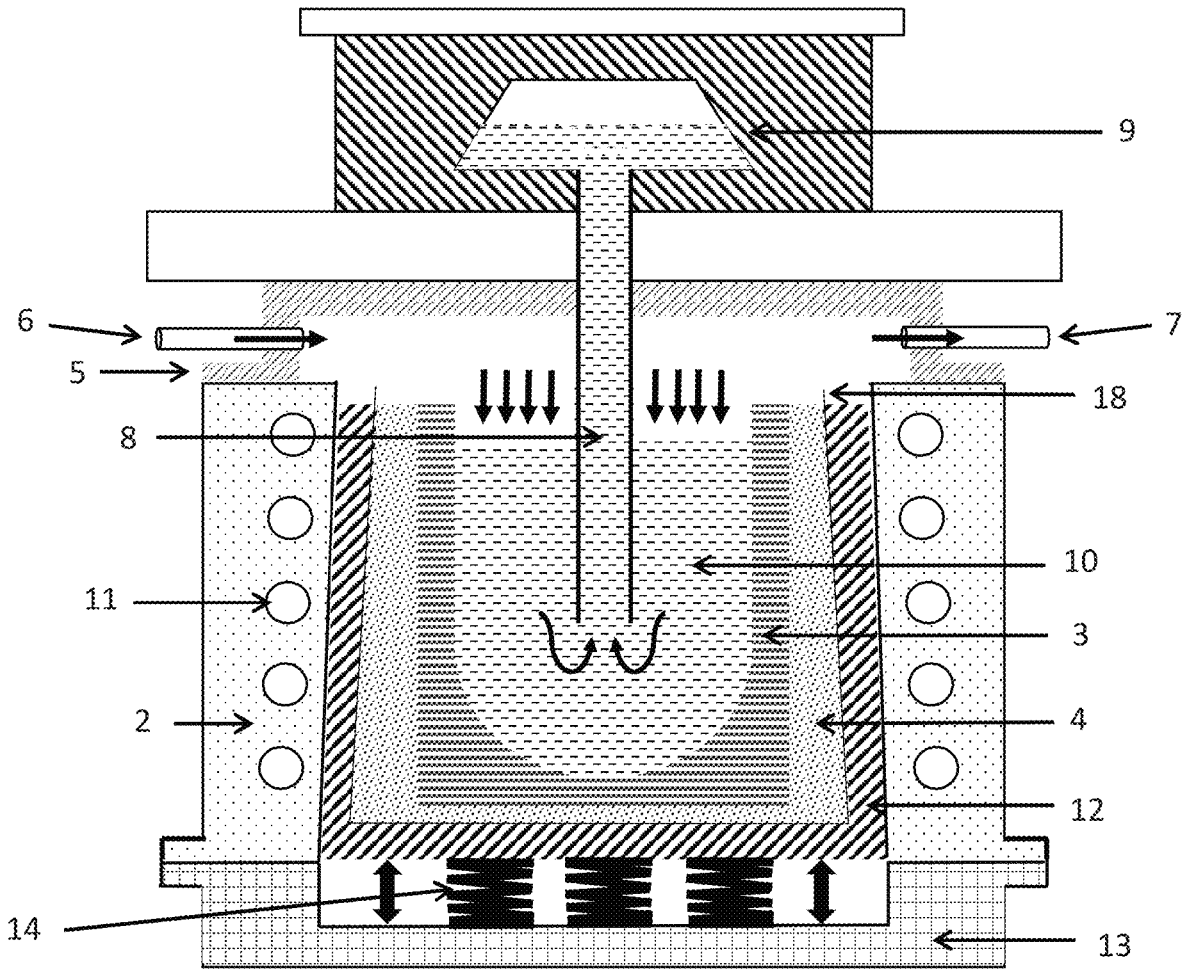
FIG. 2 shows in cross-section a second example of an arrangement according to the present invention.

FIG. 2 shows a further exemplary design of the proposed arrangement, which enables the melting container to be exchanged quickly. Here, the melting container is designed in a conical shape, and is inserted into a receiving mould 2 with a conical receiving opening. The furnace chamber is in turn formed by a steel frame (not shown in this and the following figures), by means of which the receiving mould 2 is supported. Here the receiving mould 2 has a continuous receiving opening with a conical shape. The induction coils 11 are again integrated into the receiving mould 2, as indicated in FIG. 2. In the same manner as in FIG. 1, the furnace chamber is closed off by a cover 5 with a gas supply 6, a gas outlet 7, and a continuous riser tube 8. The casting mould 9 is again positioned on the riser tube 8, that is to say, on the cover 5.

In the present example, the melting container is formed as a double-walled structure with an inner crucible 3 and a conical insert 12, between which there is a loose fill 4 of a heat-resistant material, for example high alumina. On the one hand, this porous bulk material causes the inner crucible 3 to be supported against the conical insert 12, that is to say, the receiving mould 2, and leads to a desired thermal insulating effect. On the other hand, the bulk material 4 can also absorb melt in the event of a crack in the crucible, wherein the melt then solidifies within the fine passages of the fill 4, and any further outflow of the melt is prevented.

In this example, the melting container is removed downwards from the receiving mould 2. For this purpose, a removable base plate 13 is provided, on which a spring system 14 is arranged in the present example, which spring system presses the melting container into the conical receiving opening 2. By this means, the melting container is fully supported around its periphery by the receiving mould 2. To fill the melting container with liquid melt, the furnace body is lifted off the base plate 13. The base plate 13 is then pulled out from under the furnace body and stands free so as to allow the melting container to be filled with the melt. The base plate 13 with the melting container is then positioned back under the furnace body, and the furnace body is lowered onto the base plate. The conical insert 12 of the melting container ensures a good centring, and, by means of the spring system 14, a full-surface contact of the conical insert 12 of the melting container with the inner walls of the receiving mould 2 can be ensured. Here the embodiment in terms of a spring system 14 is only one design variant. Other possibilities for adjusting the height of the melting container include mechanical solutions that operate by means of hydraulics, pneumatics or a threaded advance. With this design of the arrangement, the melting container, or just the inner crucible 3 of the melting container, can be replaced very easily and quickly in order to carry out a changeover of alloy.

Figure 3:
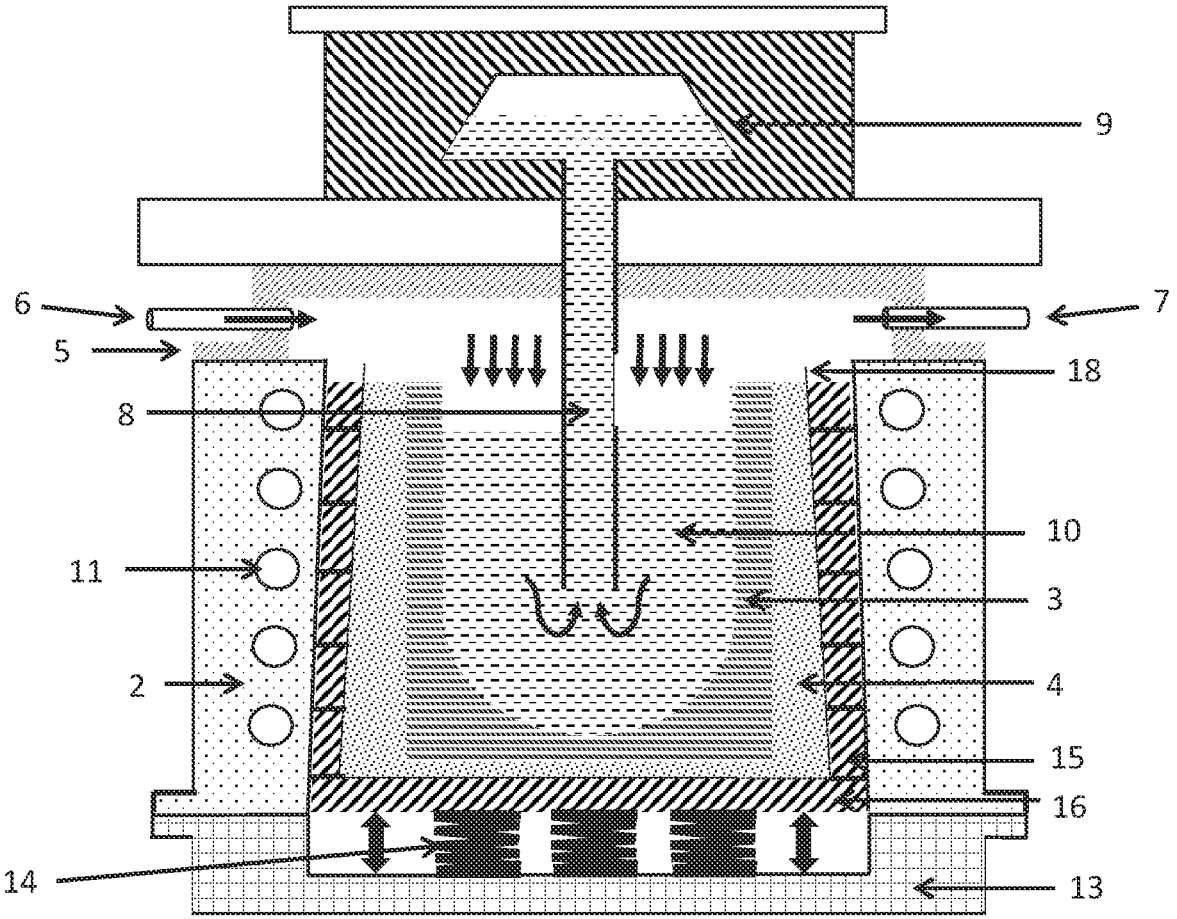
FIG. 3 shows in cross-section a third example of an arrangement according to the present invention.

In a further advantageous design, the conical insert 12 of the design of FIG. 2 can also consist of a conical tube or individual conical rings 15 and an associated base plate 16, as is exemplified in FIG. 3. The other components of this exemplary arrangement correspond to those of FIG. 2. For easier positioning, the conical rings 15 can also be assembled together by means of a tongue-and-groove system. The advantage of this design over the design of FIG. 2 lies in the greater flexibility of the melting container with respect to thermal expansion.

Figure 4:
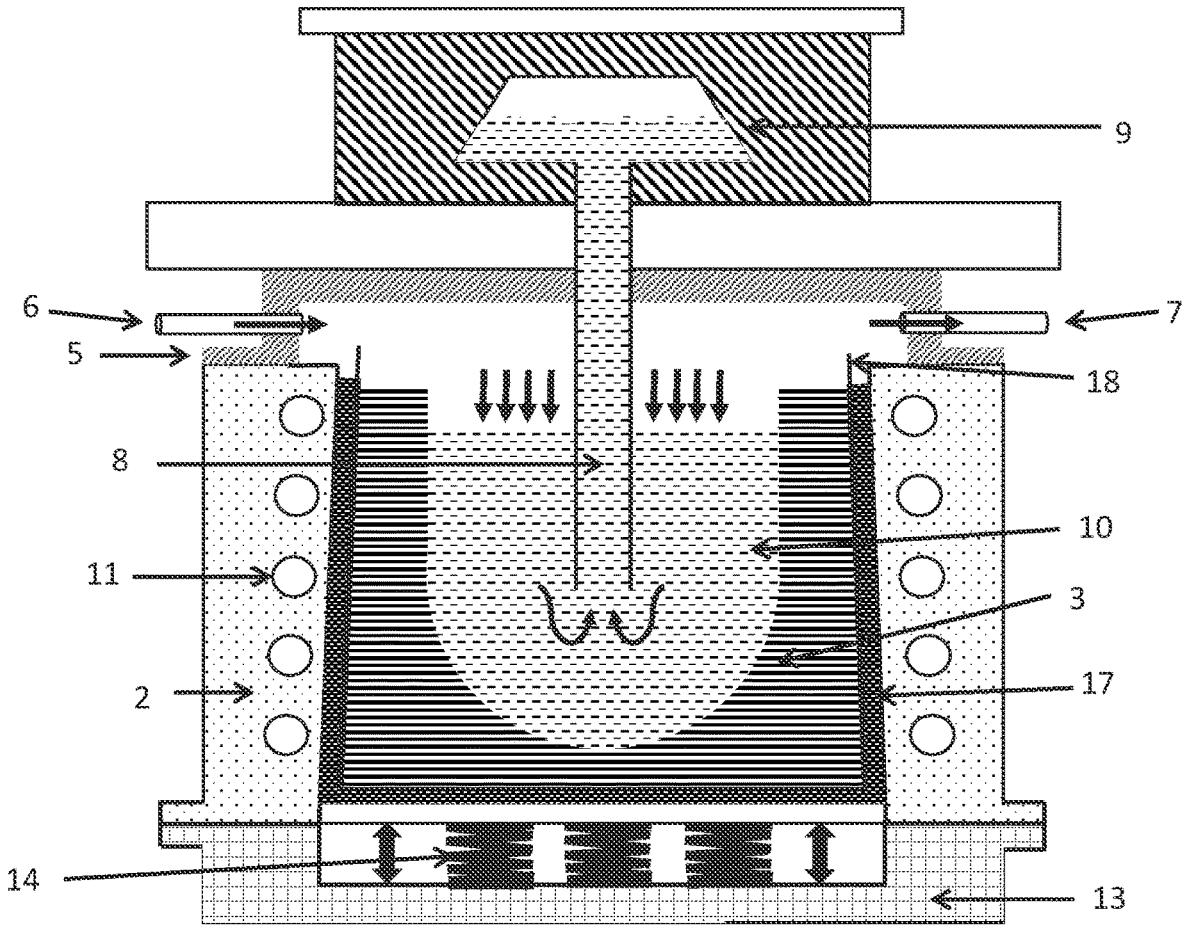
FIG. 4 shows in cross-section a fourth example of an arrangement of the present invention.
Figure 5:
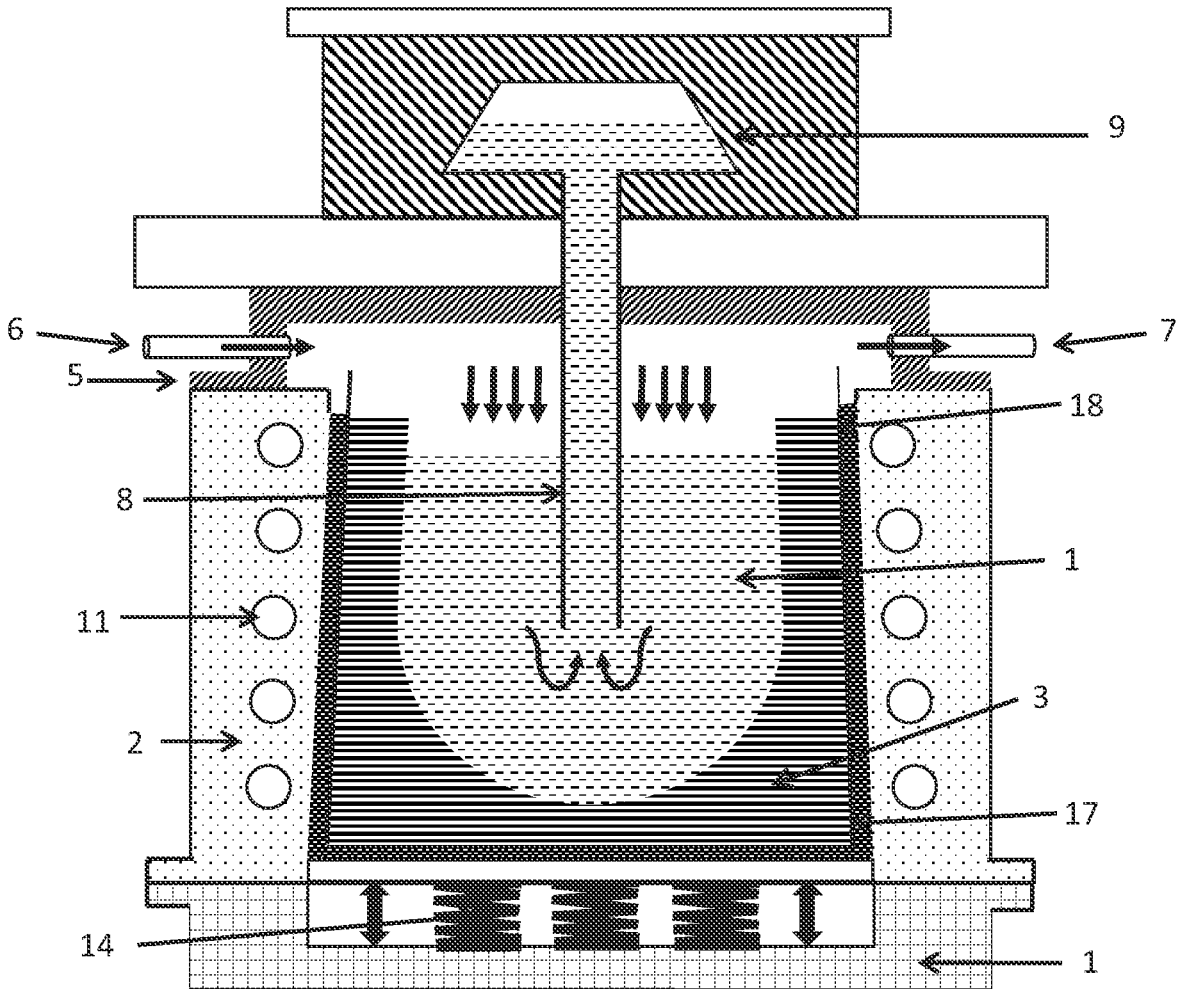
FIG. 5 shows in cross-section a fifth example of an arrangement according to the present invention.

FIGS. 4 and 5 show another possible exemplary design of the proposed arrangement, which is similar to that of FIG. 2. In these examples, in contrast to the design of FIG. 2, the melting container is formed from just an inner crucible of conical shape, with a high-temperature non-woven material 17 applied thereto; the latter can, for example, be applied to the preferably ceramic inner crucible 3 by means of a ceramic adhesive. Here the non-woven material 17 ensures insulation of the inner crucible 3 with the consequence of a better temperature homogeneity over the crucible wall. Furthermore, the non-woven material 17 provides support for the crucible 3 against the receiving mould 2, and provides compensation for simultaneous thermal expansions. The designs of FIGS. 4 and 5 differ only in that, in the design of FIG. 5, the interior of the inner crucible 3 has an undercut. This has the advantage that the distance to the lower windings of the induction coil(s) 11 can be reduced, and thus a better coupling of the electrical energy into the melt 10 can be achieved.

Figure 6:
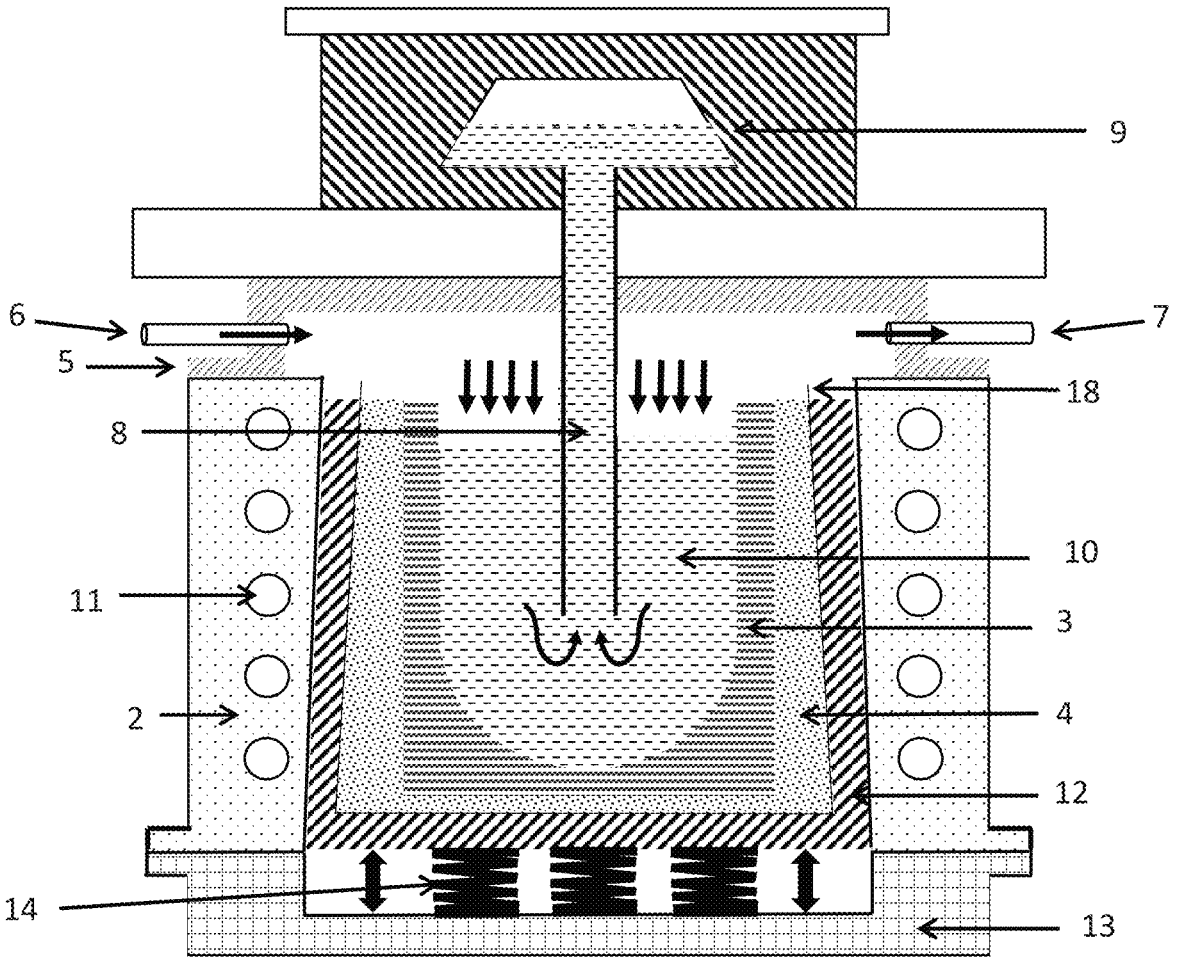
FIG. 6 shows in cross-section a sixth example of an arrangement according to the present invention.

FIG. 6 shows another advantageous form of embodiment of the design of FIG. 2. In contrast to the design of FIG. 2, this form of embodiment has a uniformly vertical arrangement of the induction coil(s) 11. By means of this vertical arrangement, a more uniform heating of the melt is achieved overall, by virtue of the now uniform distance from the melt 10.

Figure 7:
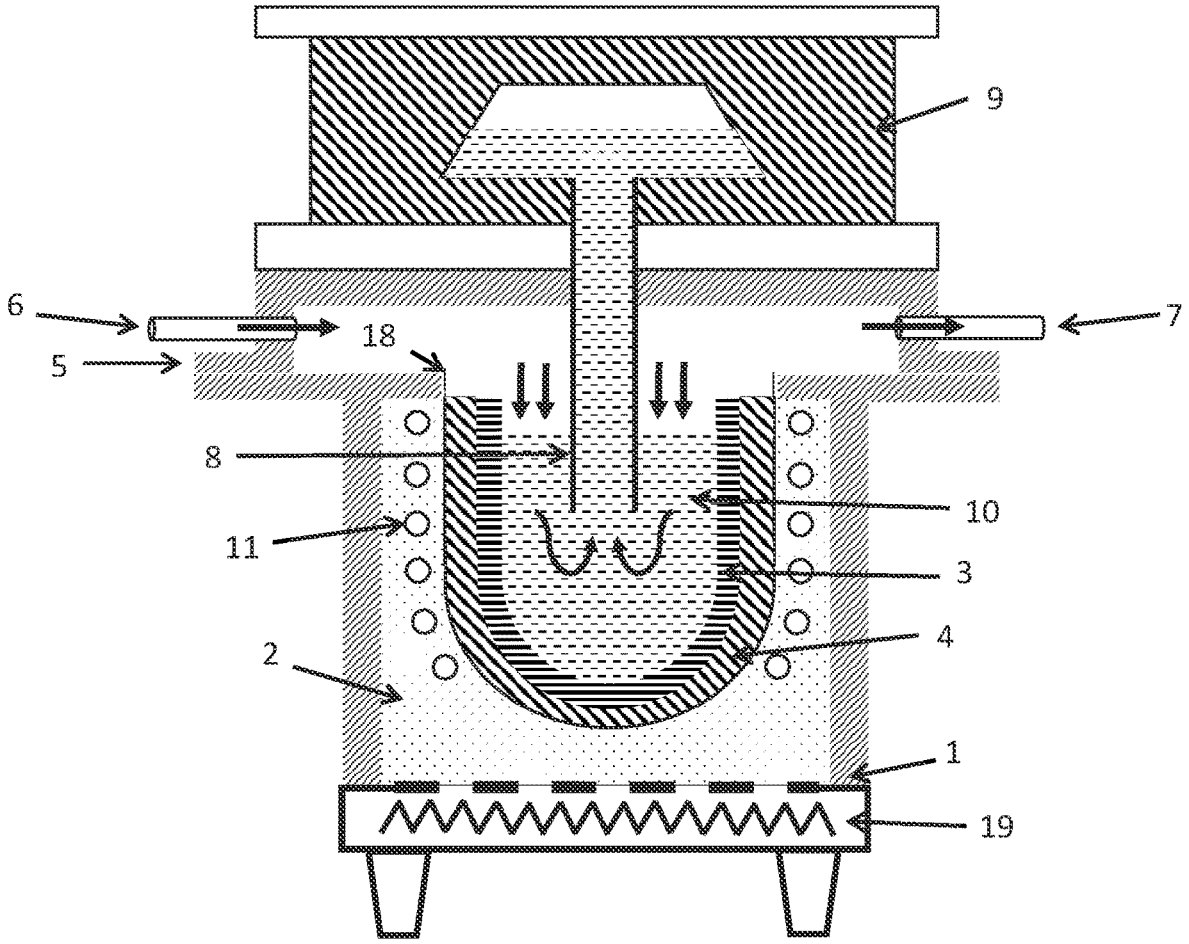
FIG. 7 shows in cross-section a seventh example of an arrangement according to the present invention.

FIG. 7 shows another advantageous form of embodiment of the design of FIG. 1. In this form of embodiment, the low-pressure casting furnace has a separate base frame 19 with resistance heating, below the steel frame 1, which permits additional preheating of the whole crucible region, usually made of ceramic. By means of this preheating, any stress cracks in the ceramic crucible caused by heating can be reduced. Alternatively, the additional resistance heater(s) can be arranged laterally, or laterally and in the base frame.

LIST OF REFERENCE SYMBOLS

1 Steel frame
2 Outer crucible/receiving mould
3 Inner crucible
4 Loose fill
5 Cover
6 Gas supply
7 Gas outlet
8 Riser pipe
9 Casting mould

10 Melt
11 Induction coil(s)
12 Conical insert
13 Base plate
14 Spring system
15 Conical rings
16 Base plate
17 High-temperature non-woven material
18 Melt detection system
19 Base frame with resistance heating

The invention claimed is:

1. Arrangement for a low-pressure casting of refractory metals, which has a furnace chamber with one or a plurality of gas supply (6) and gas outlet (7) openings, and a riser pipe (8) through a cover (5) of the furnace chamber, onto which a casting mould (9) can be positioned, a melting container (3, 12) for the refractory metals, arranged in the furnace chamber, and a heating device for heating the refractory metals in the melting container (3, 12), wherein the melting container (3, 12) is designed as an exchangeable insert for a receiving mould (2), which supports the melting container (3, 12) and is arranged in the furnace chamber, and a thermally insulating layer (4, 17) is formed between the receiving mould (2) and the melting container (3, 12), or is integrated into the melting container (3, 12);

wherein the melting container (3, 12) is formed from an inner casing (3) of a ceramic or another heat-resistant material, an outer casing (12) of a ceramic or another heat-resistant material, and an intermediate fill (4) of a heat-resistant material as said thermally insulating layer (4, 17)

wherein a receiving opening of the receiving mould (2), and the melting container (3, 12), have a conical shape; and wherein the outer casing (12) is formed by a plurality of conical rings (15) on a base plate (16).

2. Arrangement according to claim 1, characterised in that, the receiving mould (2) is supported by a steel structure (1).

3. Arrangement according to claim 1, characterised in that, the furnace chamber is formed by a steel structure (1), and the receiving mould (2) is designed as cladding of the furnace chamber.

4. Arrangement according to claim 1, characterised in that, the receiving mould (2) is formed from a ceramic or another heat-resistant material, in which one or a plurality of induction coils (11) of the heating device are embedded.

5. Arrangement according to claim 1, characterised in that, the melting container (3, 12) and the receiving mould (2) are formed such that the melting container (3. 12) is removable downwards from the receiving mould (2), and a mechanism (14) is arranged on a base plate (13) of the furnace chamber, said mechanism can press the melting container (3, 12) into the receiving mould (2) from below.

6. Arrangement according to claim 5, characterised in that, the base plate (13) of the furnace chamber is designed to be removable or detachable.

* * * * *